US008641378B2

(12) United States Patent
Fei et al.

(10) Patent No.: US 8,641,378 B2
(45) Date of Patent: Feb. 4, 2014

(54) IMPELLER FOR WATER PUMP

(75) Inventors: Song Fei, Gunma-ken (JP); Masayuki Doki, Gunma-ken (JP)

(73) Assignee: Yamada Manufacturing Co., Ltd., Kiryu-Shi, Gunma-Ken (JP)

( * ) Notice: Subject to any disclaimer, the term of this patent is extended or adjusted under 35 U.S.C. 154(b) by 478 days.

(21) Appl. No.: 13/064,719

(22) Filed: Apr. 11, 2011

(65) Prior Publication Data

US 2011/0255970 A1 Oct. 20, 2011

(30) Foreign Application Priority Data

Apr. 16, 2010 (JP) ..... 2010-95539

(51) Int. Cl.
*F04D 29/24* (2006.01)

(52) U.S. Cl.
USPC ..... 416/135; 416/204 R; 415/130

(58) Field of Classification Search
USPC ..... 415/130; 416/136, 137, 169 A, 206
See application file for complete search history.

(56) References Cited

U.S. PATENT DOCUMENTS 2,946,288 A 7/1960 Carter et al.
2,950,686 A * 8/1960 Ledel et al. ..... 415/26
3,901,623 A * 8/1975 Grennan ..... 415/141
6,669,439 B2 * 12/2003 Kardasz et al. ..... 415/131
6,935,839 B2 * 8/2005 Pascoe ..... 415/206

FOREIGN PATENT DOCUMENTS

EP 1544 474 A2 6/2005
JP 07-208393 8/1995
JP 10-122177 5/1998
WO WO 01/79703 A1 10/2001

OTHER PUBLICATIONS

European Office Action dated Jan. 30, 2013.

* cited by examiner

*Primary Examiner* — Ninh H Nguyen
(74) *Attorney, Agent, or Firm* — McGinn IP Law Group, PLLC

(57) ABSTRACT

A present invention's object is to maintain a discharge performance by making a discharge flow rate constant in a low rotation region of an engine rotation speed and to reduce the discharge flow rate in a high rotation region. The present invention consists of a housing case, an impeller base provided with plural holes and plural elliptical elongated holes, a vane body provided with a rotary shaft on an inner peripheral side and a rocking shaft on an outer peripheral side, a plate cam in which an elongated groove is formed on an outer peripheral side of a disc portion and a single torsion spring. The spring and the plate cam are housed in the housing case and the impeller base. The rotary shaft is inserted rotatably into the holes, and the rocking shaft is movably inserted into the elliptical elongated holes and the elongated groove.

4 Claims, 5 Drawing Sheets

LOW ROTATION

HIGH ROTATION

WATER PRESSURE P ON ALL ROTARY BODIES

IMPELLER FOR WATER PUMP

BACKGROUND OF THE INVENTION

1. Field of the Invention

The present invention relates to an impeller for a water pump that maintains a discharge performance by making a discharge flow rate constant in a low rotation region of an engine rotation speed and reduces the discharge flow rate in a high rotation region. Note that in this specification, a discharge flow is a cooling water flow actually discharged by the water pump per unit time, and the discharge performance is the discharge flow per unit rotation speed.

2. Description of the Related Art

In recent years, demand for reduced fuel consumption in vehicles has risen. In accordance therewith, demand for improved efficiency in respective constitutional components installed in vehicles is gradually rising. Of the constitutional components installed in a vehicle, a water pump is a component having an important function for maintaining an optimum temperature by adjusting temperatures of an engine, various electronic circuits, a heater core, and so on. Water pumps can be broadly divided into two types, namely a mechanically driven water pump and an electrically driven water pump. In recent years, use of electrically driven water pumps has increased gradually, but due to the high cost thereof, proportionally more mechanically driven water pumps remain in use at present.

An amount of circulating cooling water required to cool the engine, when considered as a ratio relative to an engine rotation speed, typically tends to increase in low and intermediate rotation regions in comparison with a high rotation region. This is in order to suppress knocking in the low and intermediate rotation regions. Therefore, although an absolute value is small in a low engine rotation speed region, a proportionally larger cooling water flow is required.

Conversely, although the absolute value is large in a high engine rotation speed region, the required cooling water flow does not increase proportionally. Further, when the cooling water flow is increased excessively, cavitation may occur. However, the discharge flow of the water pump is normally proportionate to the rotation speed. A water pump that responds to the required cooling water flow is disclosed in Japanese Patent Application Publication No. H7-208393. In the water pump disclosed in Japanese Patent Application Publication No. H7-208393, a central portion of an impeller serves as a plate spring support portion 25, deforming plate springs 24 are disposed on an impeller inner peripheral side for respective vanes, one end of the plate spring 24 is supported by a vane 13, another end of the plate spring 24 is supported by the plate spring support portion 25, and the vanes 13, which are structures that move but do not deform, are disposed on an impeller outer peripheral side.

As the impeller of the water pump rotates more quickly, a rotation speed of the vanes 13 also increases, and as a result, a water pressure force acting on the vanes 13 increases such that the vanes 13 rock in an opposite direction to a rotation direction. More specifically, the vanes 13 move from a solid line to a dotted line in FIG. 2 of Japanese Patent Application Publication No. H7-208393. Accordingly, an outer diameter of the vanes 13 decreases steadily as the impeller of the water pump rotates more quickly, and therefore, although the absolute value of the discharge flow of the water pump is large, the discharge flow decreases proportionally to the rotation speed. By performing this control, a cooling water flow is secured in the low engine rotation speed region, while in the high engine rotation speed region, unnecessary use is eliminated and cavitation is suppressed. Note that in this specification, the outer diameter of the vane denotes an outer diameter of a virtual circle traveling around an outermost periphery of the vane.

However, the following problem remains in the water pump disclosed in Japanese Patent Application Publication No. H7-208393. An amount of rocking in the vanes 13 of the water pump when the vanes 13 receive the water pressure force is determined by a balance between the water pressure force and a force of the plate springs 24. However, irregularities invariably occur in the individual characteristics and shapes of the plate springs 24 and the vanes 13, and therefore the amount of rocking (a tilt angle) in the vanes 13 varies among the respective vanes 13. When the amount of rocking in the vanes 13 varies among the respective vanes 13, the water pressure force acting on the vanes 13 becomes more irregular, leading to further irregularities in the rocking amount of the vanes 13, and thus a vicious circle is established. When the rocking amount of the vanes 13 varies in this manner, the discharge performance of the water pump also varies, and as a result, it becomes difficult to secure a desired discharge performance.

A water pump disclosed in Japanese Patent Application Publication No. H10-122177 may be cited as a constitution in which movement amounts of the respective vanes are made even, although here the impeller is moved in accordance with a water temperature rather than the water pressure force, as in the water pump disclosed in Japanese Patent Application Publication No. H7-208393. In a water pump 2 disclosed in Japanese Patent Application Publication No. H10-122177, linear slits 16 are provided in a single movable plate 13 in an identical number to the number of vanes, and a pump impeller 14 formed by engaging a pin 14a with the linear slit 16 is supported to be capable of moving within the linear slit 16 and revolving about the pin 14a. Further, a bimetal (a thermosensitive drive source) 15 is disposed upstream and in the center of the pump impeller 14, and the bimetal 15 applies a spring force to the movable plate 13 by deforming in accordance with a cooling water temperature.

As the cooling water temperature rises and falls, the bimetal 15 expands and contracts, and accordingly, the movable plate 13 rotates in a rotation direction. The pump impeller 14 is connected to the movable plate 13, and therefore, when the movable plate 13 rotates, the pump impeller 14 also moves. More specifically, when the cooling water temperature is high, the pump impeller 14 is moved outwardly in a radial direction such that an outer diameter of the pump impeller 14 increases, and as a result, the discharge performance of the water pump increases. When the cooling water temperature is low, the pump impeller 14 is moved to an inner peripheral side such that the outer diameter of the pump impeller 14 decreases, and as a result, the discharge performance of the water pump decreases.

Thus, overheating is suppressed when the temperature of the cooling water is high, and unnecessary use is reduced when the temperature of the cooling water is low. However, with the water pump constitution disclosed in Japanese Patent Application Publication No. H10-122177, all of the pump impellers 14 are driven to rotate by the bimetal (the thermosensitive drive source) 15, and therefore the vanes cannot be driven in accordance with the rotation speed, as in the water pump disclosed in Japanese Patent Application Publication No. H7-208393. Further, the bimetal 15 is disposed upstream of the pump impeller 14 so as to project to the outside of the pump impeller 14, and therefore a flow of the cooling water may be disturbed by the bimetal 15, causing the discharge performance to decrease, and as a result, cavitation may occur. Furthermore, the bimetal may not respond favorably to the constantly changing temperature of the cooling water. Hence, in the high engine rotation speed region, reductions may occur in the discharge performance and efficiency. In FIG. 1 of Japanese Patent Application Publication No. H10-122177 in particular, the bimetal 15 is axially supported by a rotary shaft 11. However, the rotary shaft 11 of the water pump is typically made of bearing steel in order to secure sufficient strength and is therefore extremely hard. As a result, as shown in FIG. 1, processing for providing a shaft on a tip end of the rotary shaft 11 requires time and money.

SUMMARY OF THE INVENTION

Hence, a problem (a technical problem or an objector the like) to be solved by the present invention is to realize an impeller for a water pump with which unnecessary use is eliminated and cavitation is suppressed while maintaining a centrifugal force action by increasing an outer diameter of a vane in a low engine rotation speed region in order to increase a discharge performance and reducing the outer diameter of the vane in a high engine rotation speed region in order to reduce the discharge performance.

As a result of committed research undertaken by the present inventor to solve the problems described above, a invention is an impeller for a water pump, including: a housing case; an impeller base fixed to the housing case and provided with a plurality of holes on a virtual inner peripheral circle side and a plurality of elliptical elongated holes on a virtual outer peripheral circle side; a vane body provided with a rotary shaft on an inner peripheral side and a rocking shaft on an outer peripheral side; a plate cam in which an elongated groove is formed on an outer peripheral side of a disc portion thereof; and a single torsion spring, wherein the torsion spring and the plate cam are housed in the housing case and the impeller base, a plurality of the vane bodies are provided on an upper, surface of the impeller base, the rotary shaft of the vane body is inserted rotatably into the holes in the impeller base, the rocking shaft of the vane body is inserted with play into the elliptical elongated hole in the impeller base and the elongated groove in the plate cam, and the rocking shaft is positioned on an outer peripheral side of the elliptical elongated hole in the impeller base by an elastic force of the torsion spring in an engine low rotation region.

In the invention, the elastic force of the torsion spring is relatively large in the low rotation region of the invention, and therefore the outer diameter of the vane body can be increased. As a result, a cooling water flow can be secured in the low rotation region of the engine, in which a proportionally large cooling water flow is required, and engine knocking can be suppressed. Further, with the present invention, the positions of all of the vane bodies can be moved by the single torsion spring, and therefore variation does not occur in the respective positions of the vane bodies. According to this constitution, a desired discharge performance can be secured in the water pump without variation. Furthermore, the present invention is constituted by the impeller part alone, and projecting members other than the impeller part are not disposed. Hence, a sufficient discharge performance can be secured without disturbing the cooling water flow. Moreover, apart from the impeller part, no other parts of the water pump require any modification, and therefore the present invention can be applied easily to a pre-existing product.

DESCRIPTION OF THE PREFERRED EMBODIMENTS

Figure 1A:
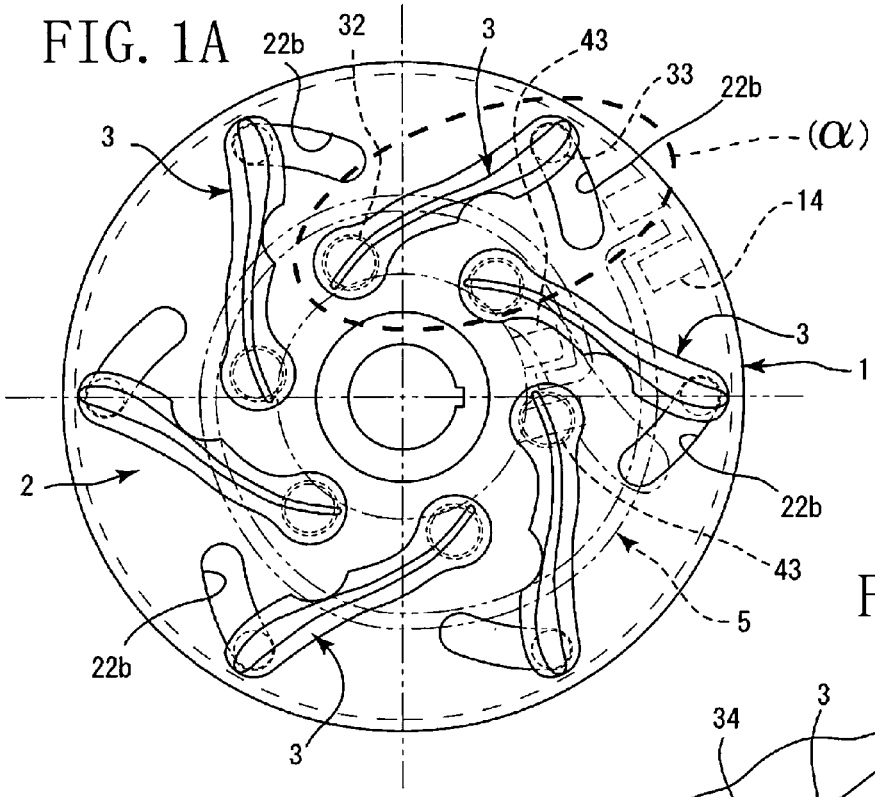
FIG. 1A is a plan view of the present invention.
Figure 1B:
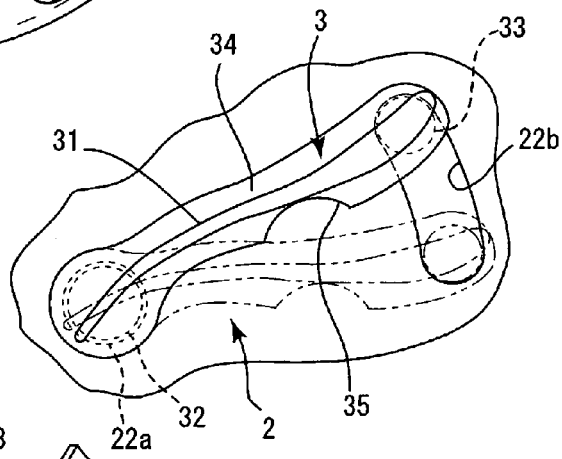
FIG. 1B is an enlarged view of a part (α) in FIG. 1A.
Figure 1C:
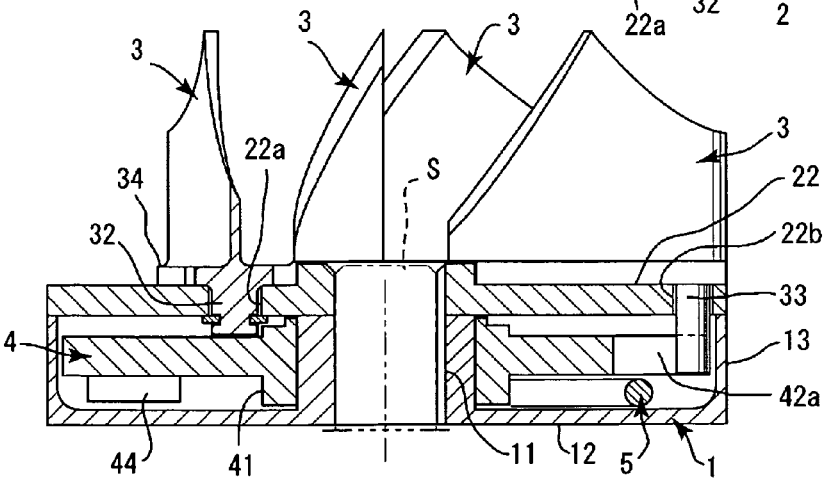
FIG. 1C is a sectional view of an appropriate location of FIG. 1A.
Figure 2:
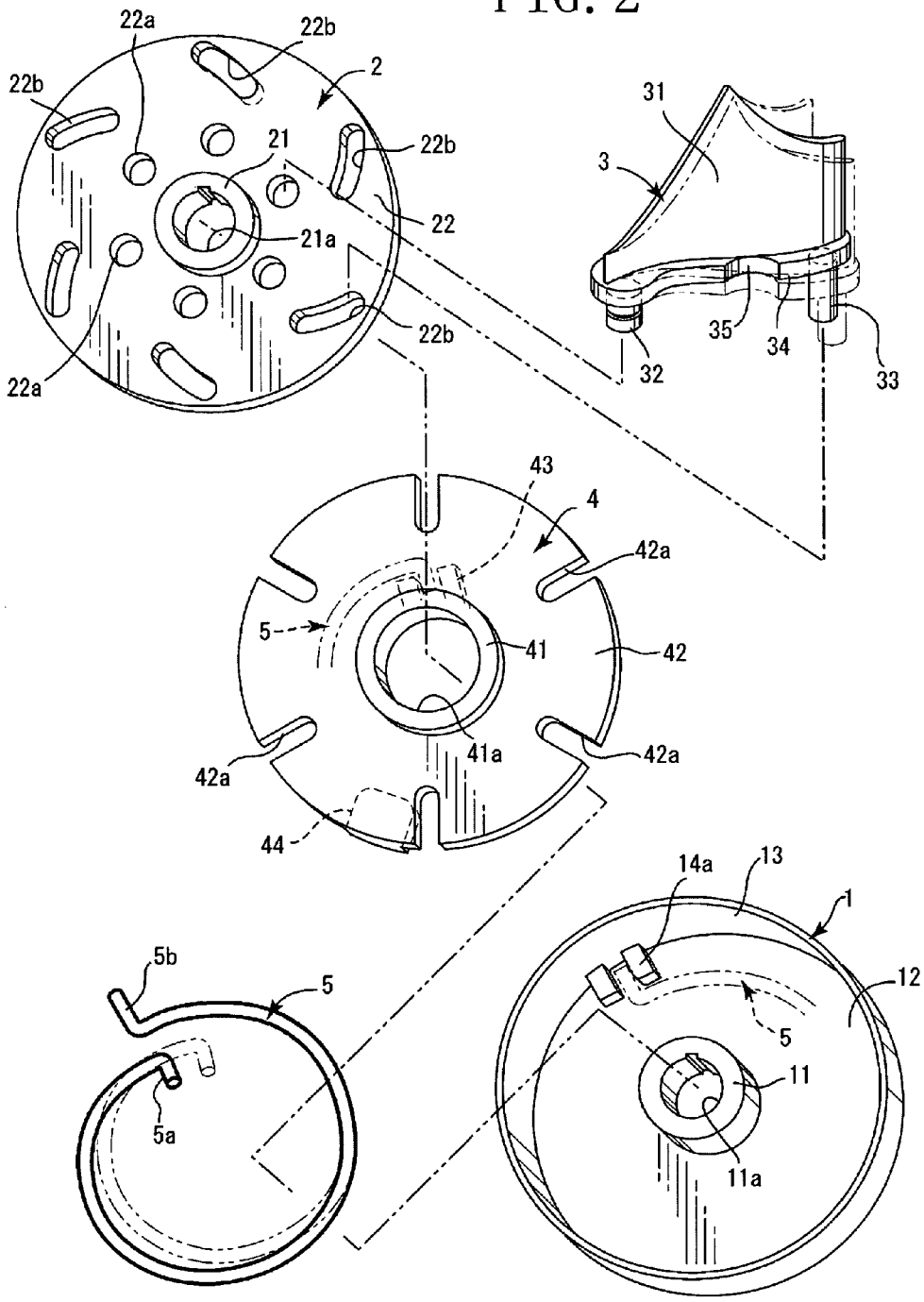
FIG. 2 is an exploded perspective view showing respective elements of the present invention.

An embodiment of the present invention will be described below on the basis of the drawings. FIGS. 1 and 2 show an embodiment of the present invention. An impeller for a water pump according to the present invention is mainly constituted by a housing case 1, an impeller base 2, a vane body 3, a plate cam 4, and a torsion spring 5. In the housing case 1, a bottom portion circular plate 12 is formed on an outer side of a lower end of a central boss portion 11, and an upright portion 13 is formed on an outermost periphery of the bottom portion circular plate 12. It is advantageous in terms of manufacture for the housing case 1 to be formed integrally. The boss portion 11 and the upright portion 13 are formed at an equal height. The plate cam 4 and the torsion spring 5 are housed in a housing location formed by the boss portion 11, the bottom portion circular plate 12, and the upright portion 13. A rotary shaft S of the water pump is inserted fixedly into the boss portion 11. The rotary shaft may be fixed to a hole portion 11*a* of the boss portion 11 by a key, press-fitting, or the like, similarly to the impeller base 2, and when a key is used, a key groove may be provided in the hole portion 11*a* of the boss portion 11.

The impeller base 2 takes a circular plate form having a similar planar shape to the housing case 1. A boss portion piece 21 having a low height is formed in a central location with a similar planar shape to the boss portion 11, and a hole portion 21*a* is formed in the center of the boss portion piece 21 at an identical diameter to the hole portion 11*a* in the boss portion 11. An upper portion main plate 22 is provided on an outer periphery of the boss portion piece 21, and an outermost periphery of the upper portion main plate 22 matches the outer diameter of the impeller base 2. Thus, the impeller base 2 is placed on an upper side of the housing case 1 to serve as a lid.

The rotary shaft is fixed similarly to the hole portion 21*a* of the boss portion piece 21 and the housing case 1. Holes 22*a* are provided at equal intervals in a virtual inner peripheral circle on an inner peripheral side of the upper portion main plate 22 of the impeller base 2. Further, elliptical elongated holes 22*b* are provided at equal intervals in a virtual outer peripheral circle on an outer peripheral side of the upper portion main plate 22 of the impeller base 2.

The vane body 3 includes a unit vane 31, a rotary shaft 32 provided on an inner peripheral side of a base of the unit vane 31, and a rocking shaft 33 provided on an outer peripheral side of the base. The rotary shaft 32 is inserted into the hole 22*a* in the upper portion main plate 22, and the rocking shaft 33 is inserted with play into the elliptical elongated hole 22*b* of the upper portion main plate 22. As a result, the vane body 3 is constituted to be capable of rocking on the impeller base 2 by an appropriate angle about the rotary shaft 32.

The unit vane 31 of the vane body 3 is formed thinly in a mountain shape when seen from a side face, and a thick reinforcing portion 34 is provided on a lower end of the unit vane 31. The rotary shaft 32 and the rocking shaft 33 are formed on a lower side of the reinforcing portion 34. Further, recessed portions 35 are formed to overlap each other steadily more closely as the unit vanes 31 approach each other in the high rotation region. The rotary shaft 32 is formed at a length that slightly exceeds a thickness of the upper portion main plate 22, while the rocking shaft 33 is formed to exceed the thickness of the upper portion main plate 22 and extend to a lower surface of the plate cam 4, where it is fixed by a clip or the like so as not to fall out.

The plate cam 4 is housed in the impeller base 2. A tubular portion 41 is formed in the center of the plate cam 4, and a disc portion 42 is formed on an outer peripheral side of the tubular portion 41. An outer diameter of the disc portion 42 is formed to be slightly smaller than that of the housing case 1 so that the plate cam 4 can be housed therein. More specifically, the disc portion 42 of the plate cam 4 is housed in the housing case 1 such that the tubular portion 41 is inserted with play rotatably into an outer peripheral portion of the boss portion 11. Elongated grooves 42*a* are formed at equal intervals in a radial direction around the entire periphery of an outer peripheral side of the disc portion 42 in an identical number to the number of vane bodies 3. The elongated groove 42*a* is formed to be long in the radial direction. The rocking shaft 33 on the outer peripheral side of the vane body 3 is inserted with play into the elongated groove 42*a*. The elongated groove 42*a* is formed such that a radial direction outer peripheral side (an outer side) thereof is open.

The torsion spring 5 is a wheel-shaped spring provided between the housing case 1 and the plate cam 4. In other words, the torsion spring 5 is interposed between a lower surface of the disc portion 42 of the plate cam 4 and an upper surface of the bottom portion circular plate 12 in order to bias the impeller in the rotation direction. More specifically, on the lower surface of the disc portion 42, an inner side bent end 5*a* of the spirally wound (almost wheel-shaped) torsion spring is latched to a latch portion 43 provided in an outer peripheral position of the boss portion 11, and on the upper surface of the bottom portion circular plate 12, an outer side bent end 5*b* of the torsion spring 5 is latched to a latch portion 14 formed in the upright portion 13 of the housing case 1.

By biasing the plate cam 4 in the rotation direction of the impeller in this manner, the vane bodies 3 are biased in the rotation direction of the impeller. A force of the torsion spring 5 is set to be equal to the water pressure force exerted on the vane bodies 3 and a centrifugal force exerted on the vane bodies 3 at a target engine rotation speed. The target rotation speed is set appropriately within a rotation speed region excluding an idling rotation speed and a MAX rotation speed.

The plurality of elliptical elongated holes 22*b* provided on the virtual outer peripheral circle side of the impeller base 2 will now be described. When the rocking shaft 33 of the vane body 3 is positioned in a position (an upper side in FIG. 1B) on the outer peripheral side of the elliptical elongated hole 22*b* (the outer peripheral side about a center O of the impeller base 2 in FIG. 1B), this position corresponds to a set position of the vane body 3 in the low rotation region of the water pump (see FIGS. 3A and 3B). In other words, when the water pump is in the low rotation region, the rocking shaft 33 of the vane body 3 rocks about the rotary shaft 32 to a position on the outer peripheral side of the elliptical elongated hole 22*b* such that the outer diameter of the unit vane 31 of the vane body 3 and a tilt angle of the unit vane 31 reach a maximum. The tilt angle denotes an outlet angle typically used in the field of water pumps.

Figure 3A:
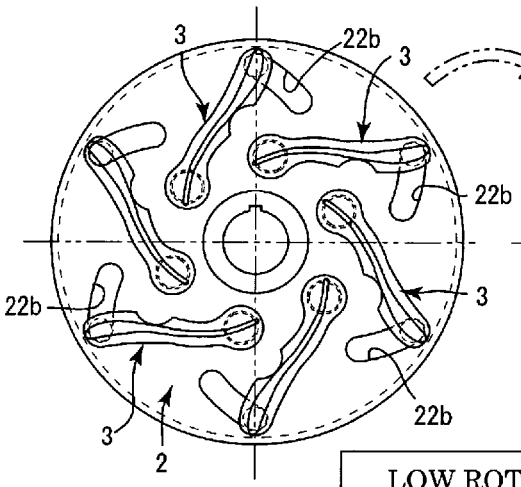
FIG. 3A is a plan view of the present invention in a low rotation region.
Figure 3B:
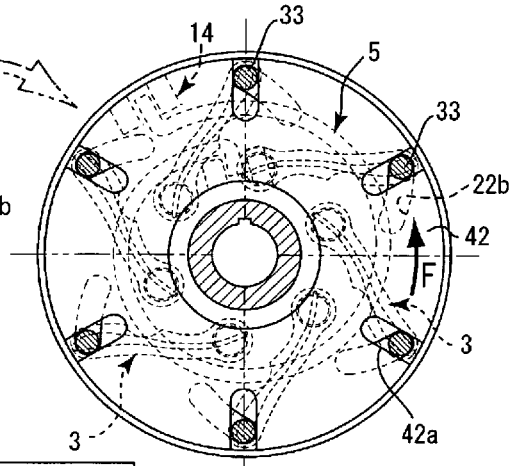
FIG. 3B is a view showing a condition in which a torsion spring and a plate cam shown in FIG. 3A are active.
Figure 3C:
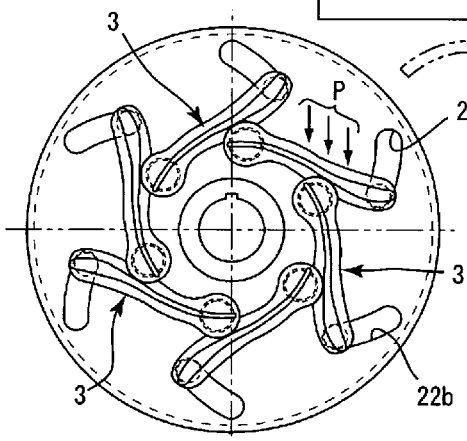
FIG. 3C is a plan view of the present invention in a high rotation region.
Figure 3D:
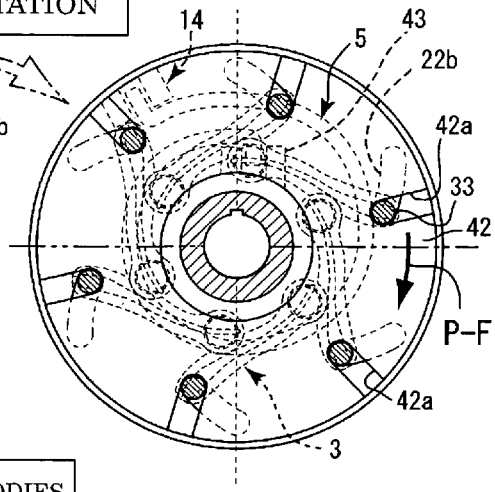
FIG. 3D is a view showing a condition in which the torsion spring and the plate cam shown in FIG. 3C are active.

Further, an inner peripheral side position (a lower side in FIG. 1B) of the elliptical elongated hole 22*b* on the outer peripheral side of the impeller base 2 corresponds to a set position of the vane body 3 in the high rotation region of the water pump (see FIGS. 3C and 3D). When the water pump is in the high rotation region, the rocking shaft 33 of the vane body 3 rocks about the rotary shaft 32 to a position on the inner peripheral side of the elliptical elongated hole 22*b* such that the outer diameter of the vane body 3 and the tilt angle of the unit vane 31 reach a minimum. In other words, by setting the inner peripheral side position of the elliptical elongated hole 22*b* on the outer peripheral side of the impeller base 2 in a position where a rotation direction rear side surface of the impeller when the vane body 3 is seen in cross-section closely approaches the next vane body 3 on the rotation direction rear side, the outer diameter of the vane body 3 can be minimized, which is most preferable.

As described above, the vane body 3 rotates about the rotary shaft 32, and since the outer peripheral side rocking shaft 33 also penetrates the elongated groove 42*a* in the plate cam 4, the torsion spring 5 deforms as the plate cam 4 rotates in a circumferential direction. When the plate cam 4 rotates in the circumferential direction at the same time as the torsion spring 5 deforms, the rocking shafts 33 of all of the vane bodies 3 rock simultaneously under the influence of the water pressure force corresponding to the engine rotation speed.

More specifically, in the low engine rotation speed region, the water pressure force is small, and therefore the tilt angle increases in accordance with the elastic force of the torsion spring 5, as indicated by an operation diagram. In the high engine rotation speed region, on the other hand, the water pressure force is large, and therefore the water pressure force presses a rotary surface of the vane body 3 against the elastic force of the torsion spring 5, eventually overcoming the torsion spring 5 such that the plate cam rotates to an opposite side in the rotation direction. As a result, the tilt angle of the vane body 3 decreases such that adjacent vane bodies 3 in the rotation direction approach each other closely.

As described above, the torsion spring 5 is housed between the housing case 1 and the impeller base 2 so as not to be exposed to an operating range of the vane body 3. The torsion spring 5 is spirally wound, and in an embodiment thereof, the torsion spring 5 is singly wound and the force thereof is determined appropriately by taking into consideration a wire diameter of the spring, a number of windings of the spring, a diameter of a single circumference of the spring, the material of the spring, and so on. Further, a water pressure force for counterbalancing the force of the torsion spring 5 is determined by "water pressure received by vane body 3"×"surface area of vane body 3" as the vane body 3 rotates. In other words, force=pressure×surface area. The centrifugal force exerted on the vane body 3 is also taken into account.

On the basis of this calculation, in the high engine rotation speed region, the force of the water pressure received by the vane body 3 is greater than the force of the torsion spring 5. In the low engine rotation speed region, the force of the water pressure received by the vane body 3 is smaller than the force of the torsion spring 5. When the engine rotation speed reaches a predetermined rotation speed, the rocking shaft 33 of the vane body 3, which has been held down up to this point by the torsion spring 5, begins to rock through the elliptical elongated hole 22*b* in the impeller base 2 toward the inner peripheral side. In this condition, the force of the torsion spring 5 and the water pressure force received by the vane body 3 become equal.

Typically, when a spring (the torsion spring 5) is used on a compression side, the force of the spring increases steadily with increases in the amount of compression. In other words, the force of the torsion spring 5 increases steadily as the rocking shaft 33 of the vane body 3 moves to the inner peripheral side. However, as the engine rotation speed rises further, the water pressure force increases, and therefore, when the engine rotation speed reaches a predetermined high rotation speed, the rocking shaft 33 of the vane body 3 arrives at an inner peripheral end of the elliptical elongated hole 22*b* in the impeller base 2. Until this condition is reached, the force of the torsion spring 5 and the water pressure force received by the vane body 3 remain equal.

The rocking shaft 33 of the vane body 3 cannot move any further, and therefore the torsion spring 5 cannot be further compressed. Hence, when the engine rotation speed rises further, the water pressure force received by the vane body 3 becomes greater than the force of the torsion spring 5, as described above. Thus, in the low engine rotation speed region, the rocking shaft 33 of the vane body 3 is positioned at an outermost peripheral end of the elliptical elongated hole 22*b* in the impeller base 2 and on the outermost periphery of the elongated hole 42*a* in the plate cam 4. In the high engine rotation speed region, on the other hand, the rocking shaft 33 of the vane body 3 is positioned at an innermost peripheral end of the elliptical elongated hole 22*b* in the impeller base 2 and an innermost peripheral end of the elongated hole 42*a* in the plate cam 4.

Figure 4A:
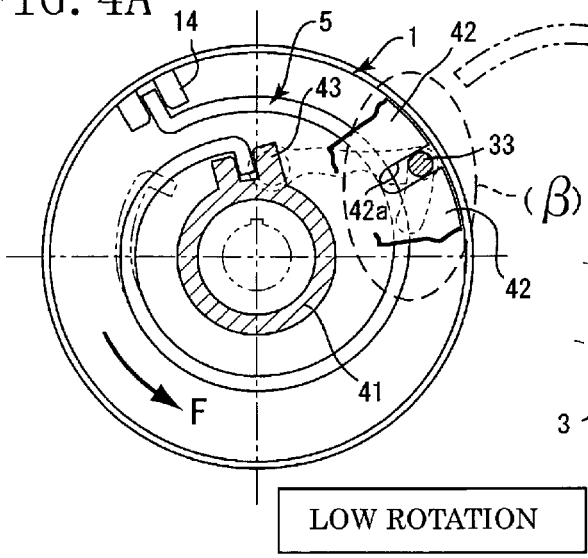
FIG. 4A is a plan view showing main parts of the present invention in the low rotation region.
Figure 4B:
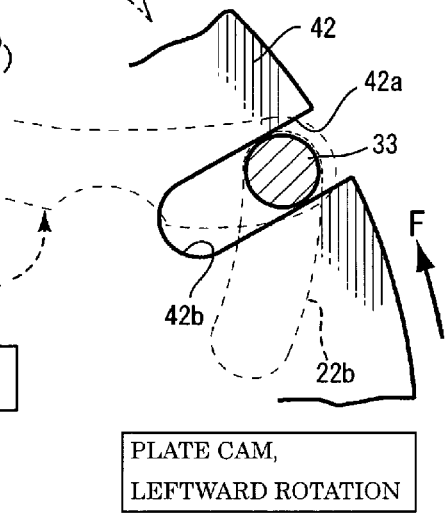
FIG. 4B is an enlarged view showing the condition of a part (β) in FIG. 4A.
Figure 4C:
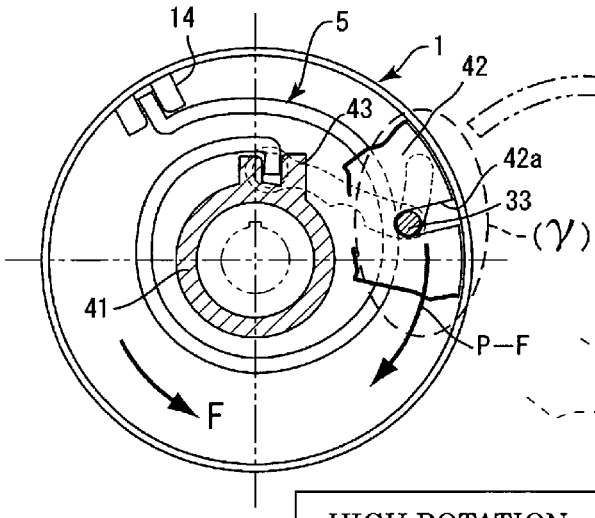
FIG. 4C is a plan view showing the main parts of the present invention in the high rotation region.
Figure 4D:
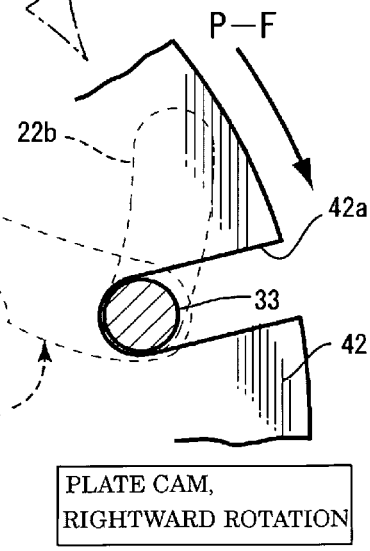
FIG. 4D is an enlarged view showing the condition of a part (γ) in FIG. 4C.

Actions of the torsion spring 5 (having a spring force F) and the water pressure force (a water pressure force P exerted on all of the vane bodies 3) in the above constitution will now be described briefly. In FIGS. 3A and 4A, the torsion spring 5 acts to cause the plate cam 4 to rotate leftward in the drawing in accordance with the spring force F such that [the rocking shaft 33] is positioned on the respective outermost peripheral sides of the elongated groove 42*a* and the elliptical elongated hole 22*b* (see FIGS. 3A, 4A and 4B). As a result, the outer diameter of the unit vane 31 of the vane body 3 and a tilt angle $\alpha$ (see FIG. 3A) of the unit vane 31 reach the maximum.

At a predetermined rotation speed in a so-called intermediate rotation region between the low engine rotation speed region (near the so-called idling rotation speed) and the high engine rotation speed region (near the MAX rotation speed), the rocking shaft 33 of the vane body 3 begins to move through the elliptical elongated hole 22*b* in the impeller base 2 from the outer peripheral end toward the inner peripheral side.

When the engine rotation speed increases to the high rotation region such that the water pressure force P is exerted on all of the vane bodies 3, the water pressure force P on the vane body 3 overcomes the elastic force of the torsion spring 5, causing the plate cam to rotate to the opposite side of the rotation direction (a rightward direction in FIGS. 3C and 3D). Accordingly, the tilt angle $\alpha$ of the vane body 3 decreases such that adjacent vane bodies 3 in the rotation direction approach each other closely, and as a result, the outer diameter and the tilt angle $\alpha$ (see FIG. 3C) of the unit vane 31 reach the minimum. In the high rotation region, the centrifugal force exerted on the vane body 3 also increases, and this centrifugal force acts on a radial direction outer peripheral side. Hence, P−F(−centrifugal force) is obtained as a rightward rotating force.

A balance structure is required in this constitution to ensure that the impeller rotates at high speed with stability. For example, a substantially square projecting portion that functions as a weight is formed integrally on the outer peripheral side and lower side of the disc forming the plate cam 4 so that balance is maintained during rotation. Further, a lack of balance is eliminated by providing a slightly larger through hole in a radial direction outer peripheral side of the disc forming the housing case 1. More specifically, a balance maintaining can be accomplished depending on materials and constitutions.

Figure 5:
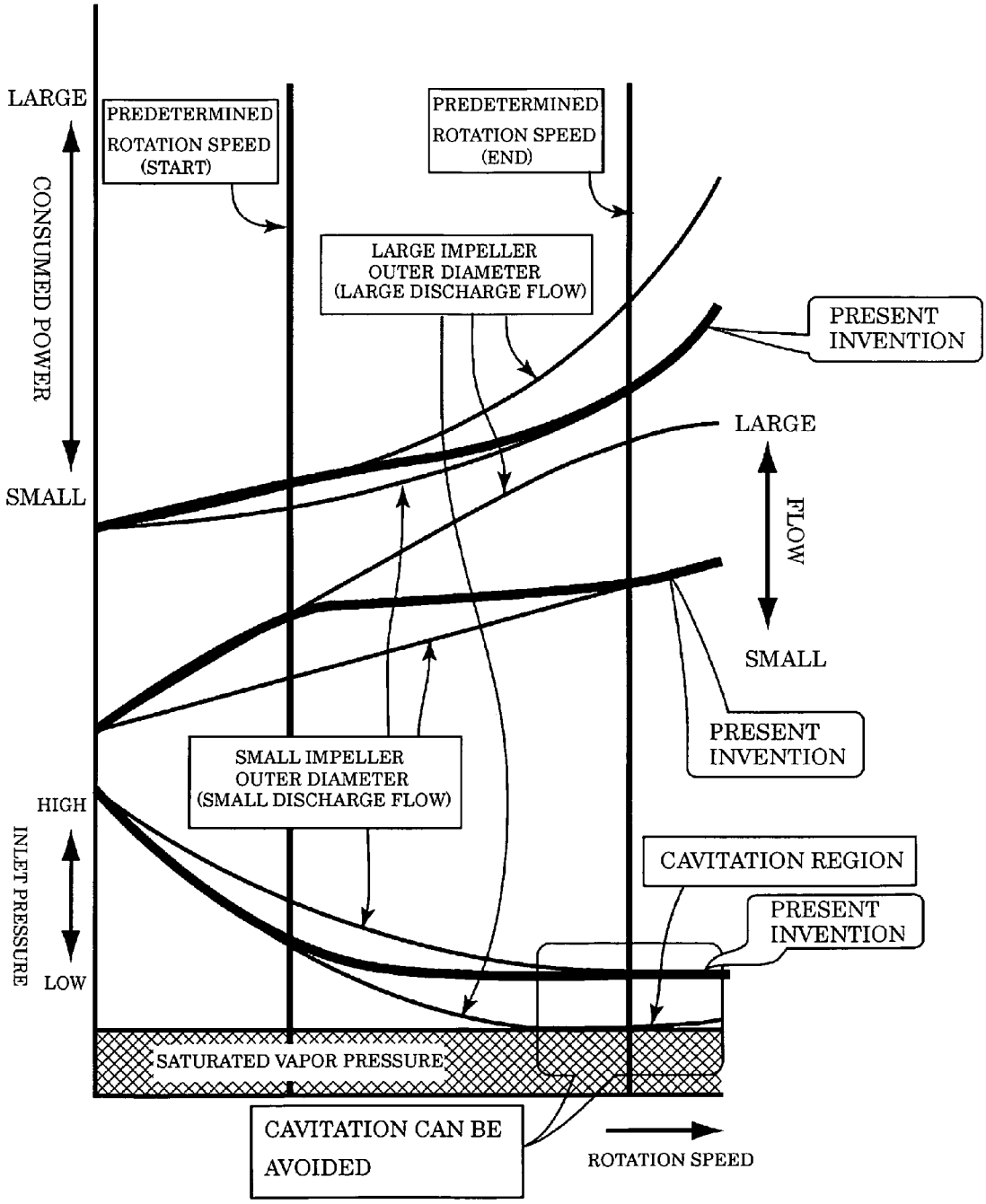
FIG. 5 is a graph showing characteristics of a discharge flow or an inlet pressure and an engine (pump) rotation speed during an operation.

Furthermore, with regard to characteristics of the discharge flow or an inlet pressure and the engine (pump) rotation speed during an operation, as shown in FIG. 5, in a low rotation region where the engine is at or below a predetermined rotation speed, the impeller outer diameter reaches the maximum, enabling an increase in the discharge performance (a large discharge flow can be secured: large pump capacity), while in the high engine rotation speed region, the discharge performance can be reduced (the discharge flow can be reduced: small pump capacity). Further, it can be seen in FIG. 5 from the course of a consumed power that the water pump is prevented from working unnecessarily in the high rotation region.

A second embodiment of the present invention is the impeller for a water pump pertaining to the first embodiment, wherein the rocking shaft 33 is positioned on an inner peripheral side of the elliptical elongated hole 22*b* in the impeller base 2 by a water pressure force exerted on the vane body 3 against the elastic force of the torsion spring 5 in an engine high rotation region. In the second embodiment, the outer diameter of the vane body 3 can be reduced in the high rotation region of the engine by counterbalancing the elastic force of the torsion spring 5, the water pressure force exerted on the vane body 3, and a centrifugal force exerted on the vane body 3. As a result, unnecessary use of the water pump in the high rotation region of the engine can be eliminated, and cavitation can be suppressed.

A third embodiment of the present invention is the impeller for a water pump pertaining to the first or second embodiment of the present invention, wherein the elongated groove 42*a* in the plate cam 4 is formed such that an outer peripheral side thereof opens onto an outermost peripheral edge of the disc portion 42. In the third embodiment, the outermost outer peripheral side of the elongated hole 22*b* in disc portion 42 of the plate cam 4 is open, and therefore the outer diameter of the disc portion 42 of the plate cam 4 can be reduced to a minimum. Accordingly, a radial direction size of the housing case 1 disposed on a radial direction outer peripheral side of the disc portion 42 of the plate cam 4 can be reduced, and as a result, an increase in space and a reduction in weight can be achieved in locations (the housing case and so on) that do not directly affect the discharge performance of the impeller.

What is claimed is:

1. An impeller for a water pump, comprising:

a housing case;

an impeller base fixed to the housing case and provided with a plurality of holes on a virtual inner peripheral circle side and a plurality of elliptical elongated holes on a virtual outer peripheral circle side;

a vane body provided with a rotary shaft on an inner peripheral side and a rocking shaft on an outer peripheral side;

a plate cam in which an elongated groove is formed on an outer peripheral side of a disc portion thereof; and a single torsion spring, wherein the torsion spring and the plate cam are housed in the housing case and the impeller base, a plurality of vane bodies are provided on an upper surface of the impeller base, the rotary shaft of vane body is inserted rotatably into the holes in the impeller base, the rocking shaft of the vane body is inserted with play into the elliptical elongated holes in the impeller base and the elongated groove in the plate cam, and the rocking shaft is positioned on an outer peripheral side of the elliptical elongated hole in the impeller base by an elastic force of the torsion spring in an engine low rotation region.

2. The impeller for a water pump according to claim 1, wherein the rocking shaft is positioned on an inner peripheral side of the elliptical elongated hole in the impeller base by a water pressure force exerted on the vane body against the elastic force of the torsion spring in an engine high rotation region.

3. The impeller for a water pump according to claim 2, wherein the elongated groove in the plate cam is formed such that an outer side thereof opens onto an outermost peripheral edge of the disc portion.

4. The impeller for a water pump according to claim 1, wherein the elongated groove in the plate cam is formed such that an outer side thereof opens onto an outermost peripheral edge of the disc portion.

* * * * *